US009644819B1

(12) United States Patent
Maresh

(10) Patent No.: US 9,644,819 B1
(45) Date of Patent: May 9, 2017

(54) FLASHLIGHT WITH AN ADJUSTABLE LIGHT BEAM REFLECTOR

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 14/544,397

(22) Filed: Dec. 30, 2014

Related U.S. Application Data

(60) Provisional application No. 61/964,282, filed on Dec. 30, 2013.

(51) Int. Cl.

| | |
|---|---|
| ***F21V 14/04*** | (2006.01) |
| ***F21L 4/00*** | (2006.01) |
| ***F21V 7/00*** | (2006.01) |
| *F21W 111/10* | (2006.01) |
| *F21Y 101/00* | (2016.01) |

(52) U.S. Cl.
CPC ..... *F21V 14/045* (2013.01); *F21L 4/005* (2013.01); *F21V 7/0025* (2013.01); *F21W 2111/10* (2013.01); *F21Y 2101/00* (2013.01)

(58) Field of Classification Search
CPC ..... F21L 4/005; F21V 7/0025; F21V 14/045; F21V 17/02; F21W 2111/10; F21Y 2101/00
See application file for complete search history.

(56) References Cited

U.S. PATENT DOCUMENTS 2,137,881 A * 11/1938 Margulies ..... F21V 17/02 248/480
4,739,457 A * 4/1988 Orr ..... F21L 15/02 362/190

* cited by examiner

*Primary Examiner* — Stephen F Husar
(74) *Attorney, Agent, or Firm* — Nick A Nichols, Jr.

(57) ABSTRACT

A flashlight may include a housing supporting a light source, a lens, a parabolic reflector and an energy source operatively connected to the light source. An adjustable light beam reflector may be mounted on the housing to intersect/deflect all or a portion of the collimated light rays projected by the flashlight. The adjustable reflector may be movably mounted on the housing for manipulation by a user to produce a wide range of light beam shapes or patterns forward of and/or generally lateral relative to the forward end of the flashlight.

14 Claims, 12 Drawing Sheets

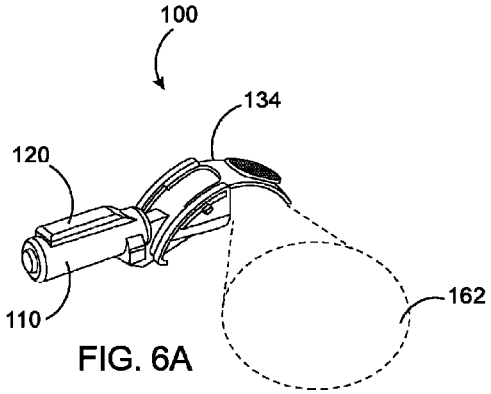
FIG. 6A
FIG. 6B
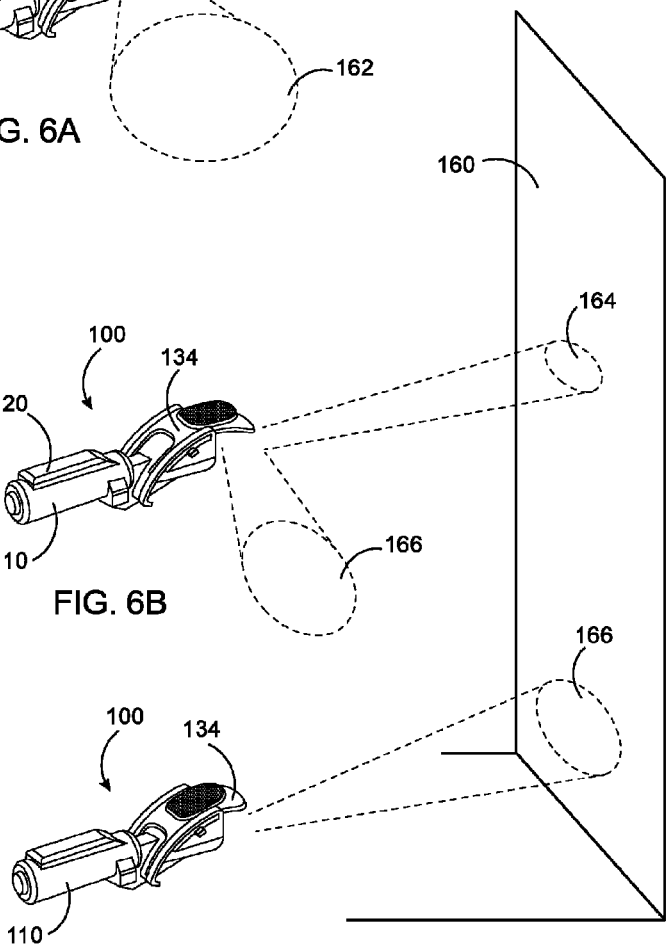
FIG. 6C

FLASHLIGHT WITH AN ADJUSTABLE LIGHT BEAM REFLECTOR

CROSS-REFERENCE TO RELATED APPLICATION

This application claims the benefit of U.S. Provisional Application Ser. No. 61/964,282, filed Dec. 30, 2013, which application is incorporated herein in its entirety by reference.

BACKGROUND

The present invention relates generally to flashlights and more particularly to a flashlight with an adjustable light beam reflector.

Adjustable beam flashlights typically project a light beam that may be adjusted from a spot projected beam to a broad projected beam. The spot beam may be best produced by an axially symmetric concave parabolic reflector (or a modified paraboloid where the paraboloid is modified to project a spot beam of the intended pattern diameter) with the light source close to the focus of the paraboloid which produces generally collimated light rays resulting in a high intensity spot beam of light. The light beam may be broadened, as for example, in a conical shaped beam, by moving the light source further away from the focus of the paraboloid, preferably but not necessarily toward the larger end of the paraboloid, to produce a relatively nonparallel and diffuse radiating beam. A defocused spot beam, however, is not a good flood beam because the distribution of light is highly uneven. A spot beam is generally poorly suited for illuminating a nearby object because the intensity of the illumination is typically too great and the field of illumination is too narrow. Likewise, a flood beam is generally not suited for illuminating distant objects because the light beam is typically to diffuse to illuminate the distant object.

SUMMARY

A flashlight may include a housing supporting a light source, a lens, a parabolic reflector and an energy source operatively connected to the light source. An adjustable light beam reflector may be mounted on the housing to intersect/deflect all or a portion of the collimated light rays projected by the flashlight. The adjustable reflector may be movably mounted on the housing for manipulation by a user to produce a wide range of light beam shapes or patterns forward of and/or generally lateral relative to the forward end of the flashlight.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 6A is a perspective view of the flashlight shown in FIG. 1 illustrating the projection of a light beam when the adjustable beam reflector is in the fully extended position;

FIG. 6B is a perspective view of the flashlight shown in FIG. 1 illustrating the projection of a light beam when the adjustable beam reflector is in intermediate position;

FIG. 6C is a perspective view of the flashlight shown in FIG. 1 illustrating the projection of a light beam when the adjustable beam reflector is in the fully retracted position;

DETAILED DESCRIPTION

Figure 1:
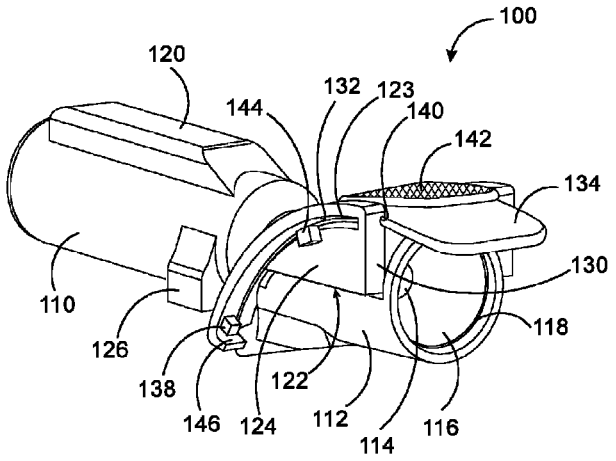
FIG. 1 is a perspective view of the a flashlight with an adjustable beam reflector.
Figure 2:
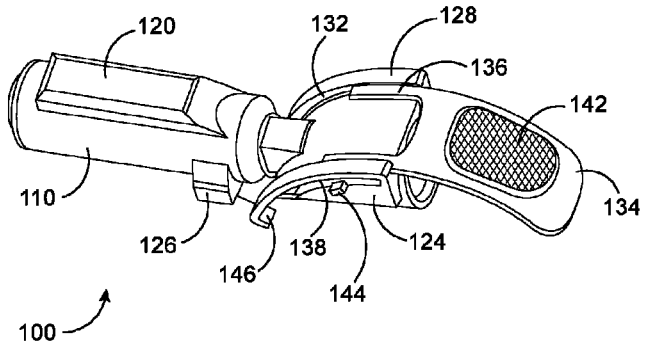
FIG. 2 is a perspective view of the flashlight shown in FIG. 1 illustration the adjustable beam reflector in a fully extending position.

Referring now to the drawings, in which like reference numerals indicate corresponding elements throughout all the drawing figures, attention if first directed to FIG. 1 in which a flashlight with an adjustable light beam reflector is generally identified by the reference numeral 100. The flashlight 100 may include, for purposes of illustration but not by way of limitation, a substantially cylindrical body 110 housing an energy source and a light source arranged in a circuit typical of most prior art flashlights. The flashlight body 110 may include a head portion 112 typically cast as one piece with the body 110. The head portion 112 may support a light source 114, such as an LED or incandescent bulb. The light source 114 may be located proximate the focus point of a light reflector 116, typically a parabolic reflector, supported in the head portion 112 of the flashlight body 110. A lens 118 may be secured to the front end of the head portion 112 enclosing the light source 114 and reflector 116 within the flashlight body 110. A switch 120 may be mounted to the flashlight body 110 to form a normally open electrical circuit. Actuation of the switch 120 closes the electrical circuit to supply power to the light source 114.

Referring still to FIG. 1, a bracket 122 is fixedly secured to the flashlight body 110. The bracket 122 may include a forward portion 124 configured to mate with the upper cylindrical surface of the head portion 112 of the flashlight body 110. A rearward portion 126 of the bracket 122 may be configured to mate with lower cylindrical surface of the flashlight body 110. The bracket 122 may include raised ridges 128 that extend generally from a front face 130 of the bracket portion 124 to the rearward portion 126. The ridges 128 may be spaced relative to one another and define a channel therebetween. Each of the ridges 128 may further include a race 132 generally defining a curved path.

Figure 5:
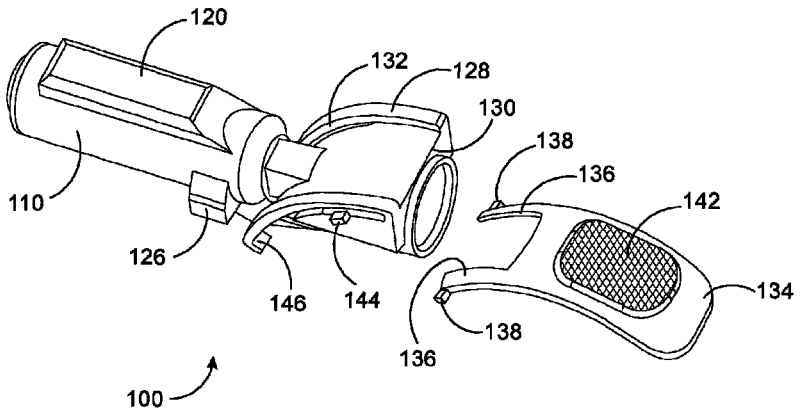
FIG. 5 is an exploded perspective view of the flashlight shown in FIG. 1.

An adjustable light beam reflector 134 may be slidably supported by the bracket 122. The reflector 134 may include a generally elongated body with a slight curvature, best shown in FIG. 5, generally matching the curvature of the ridges 128. The reflector 134 may include a pair of spaced arms 136 extending from a distal end thereof. The arms 136 may be provided with outwardly extending tabs 138 sized and configured to extend into the races 132 in the ridges 128. The ridges 128 may include axial grooves 140 sized to slidably receive the lateral sides of the reflector 134.

The reflector 134 may be movably attached to the bracket 122 by flexing the arms 136 toward each other and sliding them through the grooves 140. Thereafter releasing the arms 136 to expand outwardly and thereby positioning the tabs 138 in the races 132 of the ridges 128. A thumb grip 142 may be provided on the top surface of the reflector 134 to facilitate transmission of a force from a user's thumb to slide the reflector 134 to a desired position. The reflector 134 may be constrained to move between a forward stop 144 and a rear stop 146 in the races 132.

Figure 3A:
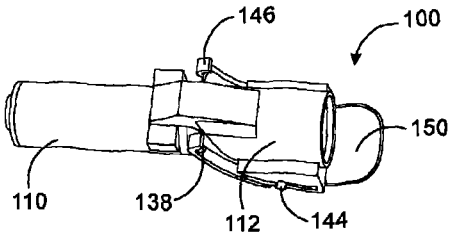
FIG. 3A is a bottom perspective of the flashlight shown in FIG. 1 illustration the adjustable beam reflector in a fully retracted position.
Figure 3B:
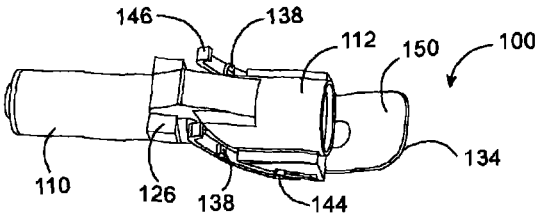
FIG. 3B is a bottom perspective of the flashlight shown in FIG. 1 illustration the adjustable beam reflector in an intermediate position.
Figure 3C:
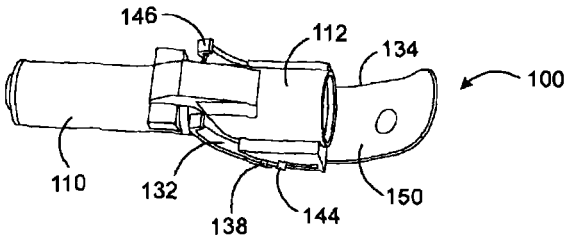
FIG. 3C is a bottom perspective of the flashlight shown in FIG. 1 illustration the adjustable beam reflector in a fully extended position.
Figure 4:
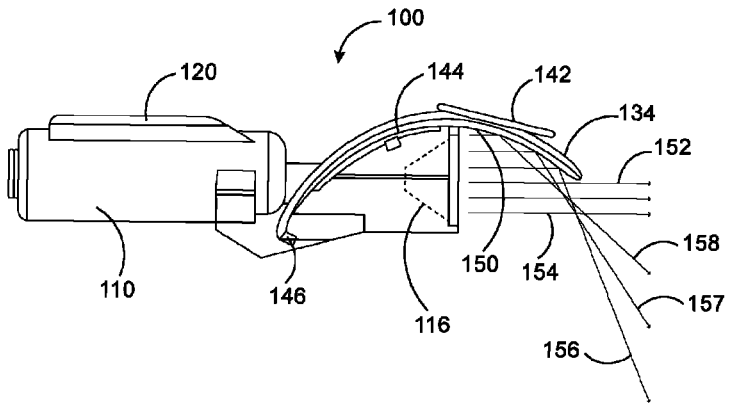
FIG. 4 is a perspective partial section view of the flashlight shown in FIG. 1.

Referring now to FIGS. 3A-3C, the bottom perspective views show the adjustable reflector 134 at three different positions. In FIG. 3A, the reflector 134 is fully retracted to the rearmost position with the tabs 138 juxtaposed against the rear race stop 146. In this position, the reflector 134 does not intercept the light beam projected by the light source 114. In FIG. 3B, the reflector 134 is shown advanced to an intermediate position so that it partially intercepts the light beam projected by the light source 114. Light rays 152, 154 are not deflected by the mirrored surface 150 of the reflector 134 whereas light rays 156, 157, 158 are incepted and laterally deflected by the mirrored surface 150 of the reflector 134. In FIG. 3C, the reflector 134 is advanced to the fully extended position with the tabs 138 juxtaposed against the forward race stop 144. In this position, all of the light beam projected by the light source 114 is deflected laterally by the reflector 134, generally downward toward the ground or walking path surface.

In FIGS. 6A-6C, exemplary light beams or patterns that may be projected by the flashlight 100 toward the ground and/or a distant object 160, such as a wall, are illustrated. In FIG. 6A, the reflector 134 is depicted advanced to its fully extended position and thereby deflecting the entire light beam projected the light source 114 to a near field broad beam 162 toward the ground. In FIG. 6B, the reflector 134 is in an intermediate position. The projected light beam from the light source 114 is divided into a spot beam 164 at the wall 160 and a broad beam at the ground. In FIG. 6C, the reflector is illustrated in the fully retracted position so that the projected light beam is directed toward a forward spot beam 166 at the wall 160. Many near field and far field light beam projections may be generated by incremental advancement of the reflector 134 between the race stops 144, 146.

Figure 7:
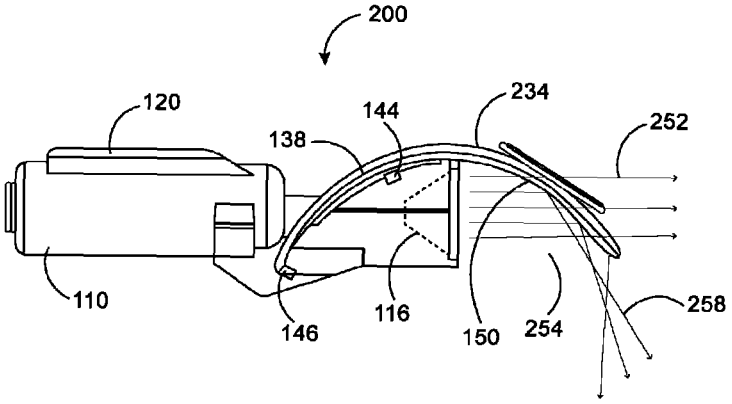
FIG. 7 is a perspective partial section view of a second embodiment of a flashlight with an adjustable beam reflector.
Figure 8A:
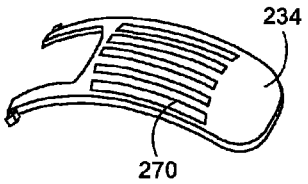
FIG. 8A is a perspective view of an adjustable beam reflector illustration a plurality of slots extending through the adjustable beam reflector.
Figure 8B:
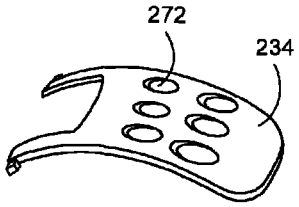
FIG. 8B is a perspective view of an adjustable beam reflector illustration a plurality of holes extending through the adjustable beam reflector.

Referring now to FIG. 7, a second embodiment of a flashlight with an adjustable light beam reflector is generally identified by the reference numeral 200. The flashlight 200 is substantially similar to the flashlight 100 described above with the exception that the flashlight 200 includes an adjustable reflector 234 that includes a plurality of apertures. By way of illustration but not by limitation, FIG. 8A illustrates a reflector 234 that includes a plurality of slots 270 and the reflector 234 illustrated in FIG. 8B includes a plurality of holes 272. The reflector 234 may include apertures of various sizes and shapes, such as, but not limited to, stars, half moons, tear drops and/or any number of combinations thereof.

Some light rays will be unobstructed by the reflector 234, even when the reflector 234 is in the fully extended position, shown in FIG. 7. Light rays 252 may pass through the apertures to illuminate a distance object, while light rays 254, 258 may be laterally deflected toward the ground.

Figure 9:
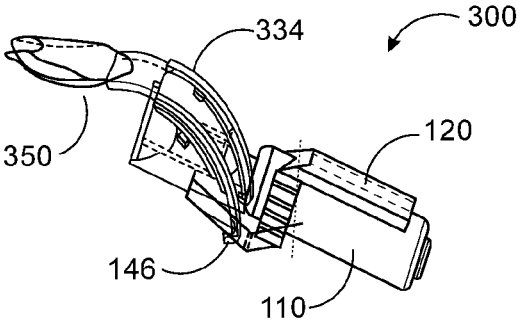
FIG. 9 is a perspective view of a third embodiment of a flashlight with an adjustable beam reflector.
Figure 10:
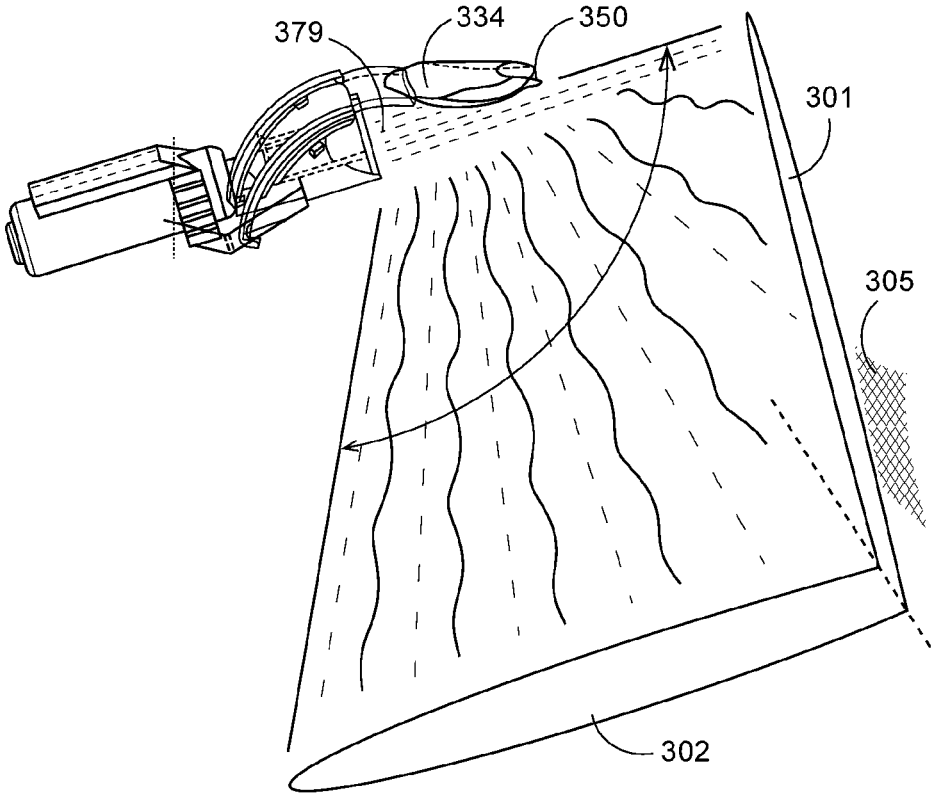
FIG. 10 is a perspective view illustrating a light beam projection of the flashlight shown in FIG. 9.
Figure 11A:
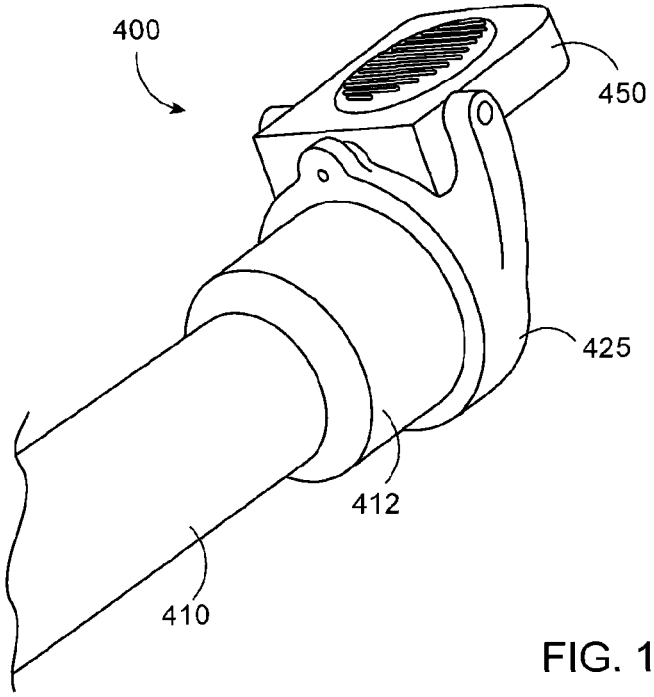
FIG. 11A is a perspective view of a fourth embodiment of a flashlight with an adjustable beam reflector.
Figure 11B:
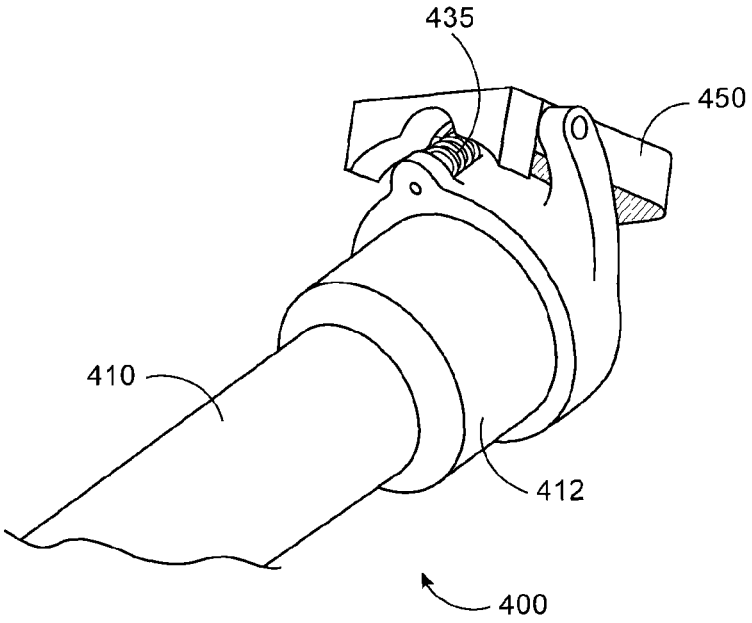
FIG. 11B is a perspective view of the flashlight shown in FIG. 12A illustrating the adjustable beam reflector in a light beam incepting position.
Figure 11C:
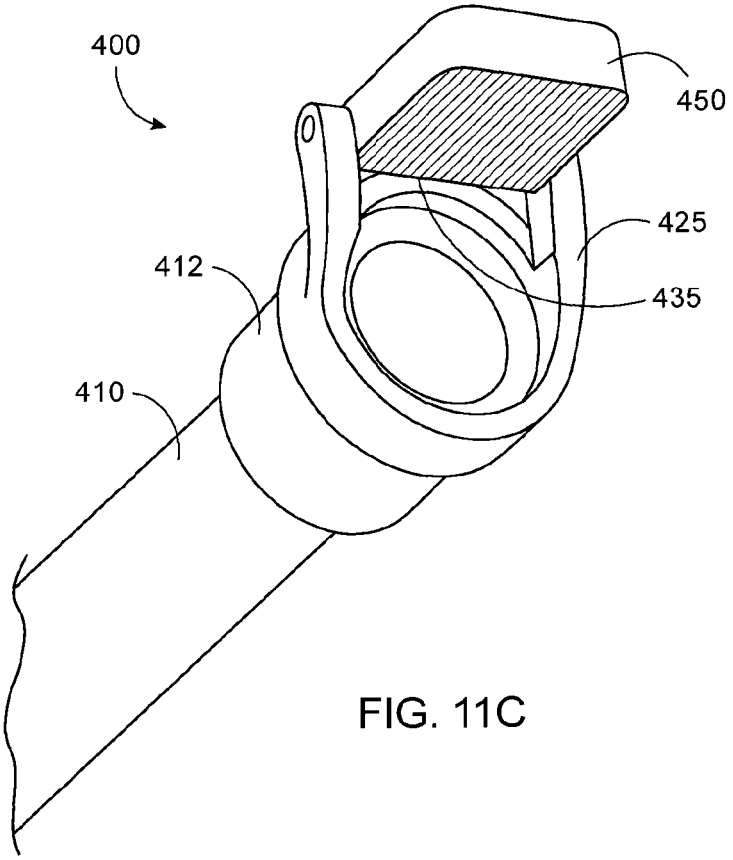
FIG. 11C is a front perspective view of the flashlight shown in FIG. 12A.
Figure 11D:
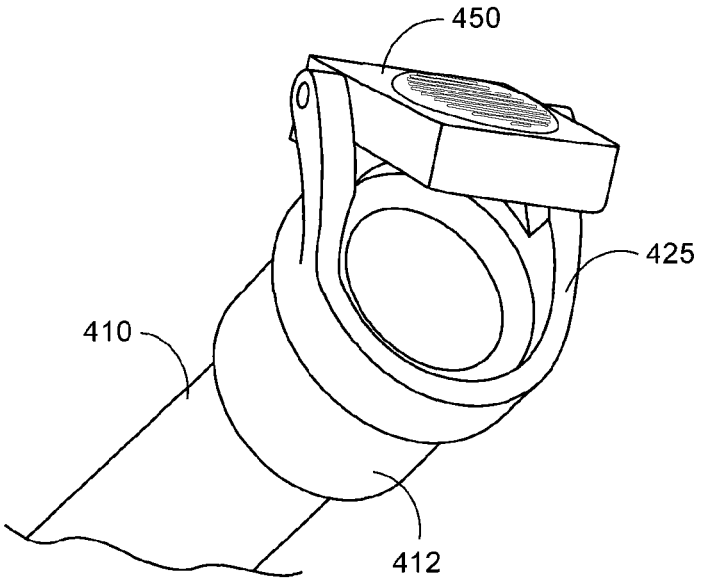
FIG. 11D is a front perspective view of the flashlight shown in FIG. 12B.

Referring now to FIG. 9, a third embodiment of a flashlight with an adjustable light beam reflector is generally identified by the reference numeral 300. The flashlight 300 is substantially similar to the flashlight 100 described above with the exception that the flashlight 300 includes an adjustable reflector 334 having a convex mirrored surface 350. Several variables may be considered when designing the reflector 334. For example, under certain conditions a convex spoon shape may be expected to yield a broad light beam in the lateral direction, and under other design parameters or conditions a narrow light beam may be produced. Part of the consideration involves whether intersecting light waves are permitted, and also the magnitude of the acute (or oblique) angle created in the generally longitudinal direction. In the configuration illustrated in FIG. 10, the orientation and location of the spoon shaped geometry of the reflector 334 produces a narrow path of significant length, but the same reflector 334 may be repositioned and reorientated to produce only a broad near field light beam pattern. In FIG. 10, the convex (down) profile of reflector convex surface 350, as viewed from the side, greatly extends the near field projection of light rays 379 in the longitudinal direction (in front of the user). This extended near field narrow light beam pattern may merge with the far field (illustrative 'wall' 305) spot beam pattern 301 such that one continuous narrow light field is provided with near and far field foot path illumination. Note that although this reflector convex surface 350 is "spoon" shaped, or a truncated spoon shape, the side to side convex (down) profile as viewed from the front of the reflector convex surface 350 has a minimal effect (as per design option) in broadening near field light pattern 302 relative to the maximum effect of the front to rear convex (down) mirrored surface. Different combinations of movable reflector convex and/or flat mirrored surfaces may be combined as desired in order to achieve a given end result of light beam patterns. Also, with the movable reflector 334, further considerations of variations in light beam pattern may be possible with regard to optical design of the mirrored reflector surface 350, such as employing faceted mirrored surfaces, or matted surfaces and the like.

With regard to the mirrored reflector surfaces, the adjustable reflector may typically be made from a plastic material such as acrylonitrile-butadiene-stryene (ABS), polycarbonate or styrene-acrylonitri Ic (SANS), and the reflective surfaces may be created by vacuum depositing a metal onto the plastic material (metalized) with a light-reflecting metal such as silver or aluminum. Typically, inexpensive production reflectors may be coated with a thin layer of lacquer, then aluminum is deposited in a vacuum (vapor deposited aluminum, VDA) and finally a second layer of lacquer may be applied in order to protect the aluminum reflective surface. Alternately, the adjustable reflector may simply be formed from a high quality stainless steel such as 316 grade or better, or chrome plated steel, and polished to the degree desired. An additional option may be to employ metal-loaded paints at the reflector surface. As indicated previously, the movable reflector may be a computer generated parabola, modified or unmodified, and with or without the addition of flat (faceted) or complex curved profiles. Also, small discrete flat surfaces may be provided, or an "orange peel" texture may be provided. These alterations serve largely to scatter or diffuse light, primarily to the near field, as may be required by design considerations.

Referring now to FIGS. 11A-11D, collectively, a fourth embodiment of a flashlight with an adjustable light beam reflector is generally identified by the reference numeral 400. The flashlight 400 may include, for purposes of illustration but not by way of limitation, a substantially cylindrical body 410 housing an energy source and a light source arranged in a circuit typical of most prior art flashlights. The flashlight body 410 may include a head portion 412 typically cast as one piece with the body 410. The head portion 412 may support an adjustable reflector 450 is rotatably secured to a yoke base 425. The yoke base 425 may be secured to head portion 412 of the flashlight body 410. A compression spring 435 may be secured between the reflector 450 and the yoke base 425. The reflector 425 may be biased to a position which does not obstruct any light rays emanating from the light source of the flashlight 400. During use, the reflector 450 may be tilted more or less with a user's thumb while deflecting at least a portion of the available light beam downward to the ground terrain or foot path.

Figure 12:
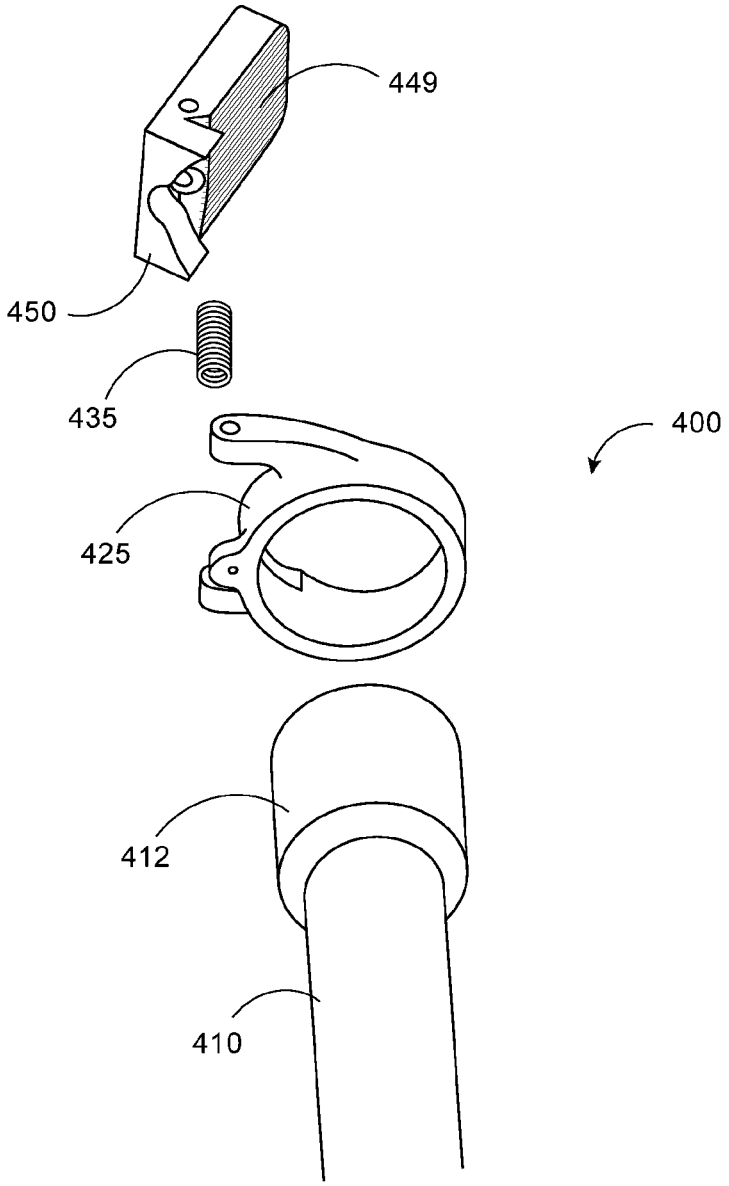
FIG. 12 is an exploded perspective of the flashlight shown in FIG. 12A.

An exploded view of the flashlight 400 is shown in FIG. 12, wherein the reflector 450, compression spring 435, yoke base 425, and flashlight body 410 are separated for purpose of illustration. The reflector 450 is shown to include a prismatic or faceted reflective surface 449 to facilitate near field scattering of deflected light rays.

Figure 13A:
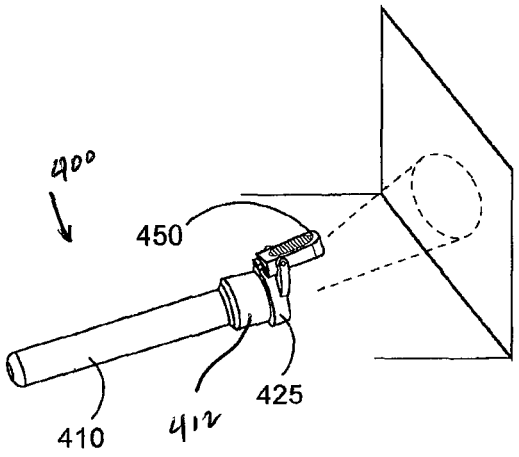
FIG. 13A a is a perspective view illustrating a light beam projection of the flashlight shown in FIG. 11C with the beam reflector in a light beam non-intercepting position.
Figure 13B:
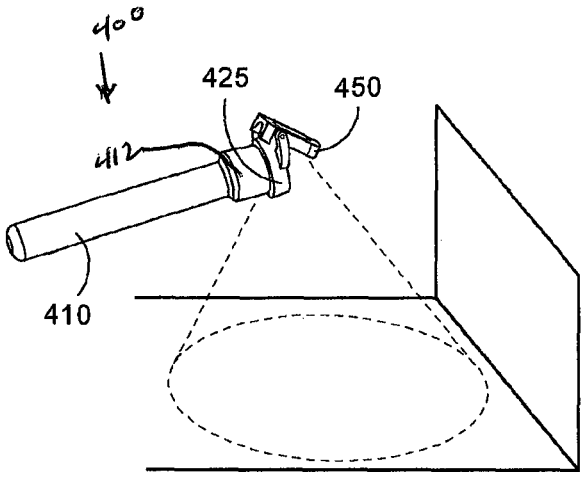
FIG. 13B a is a perspective view illustrating a light beam projection of the flashlight shown in FIG. 11B with the beam reflector in a light beam intercepting position.

Referring now to FIG. 13A and FIG. 13 B, the flashlight 400 is shown illustrating reflector 450 flipped up thus allowing all available light to be projected to a distant spot target, and FIG. 13 B illustrates the reflector 450 to be tilted down thus deflecting at least a portion of the available light laterally.

Figure 14A:
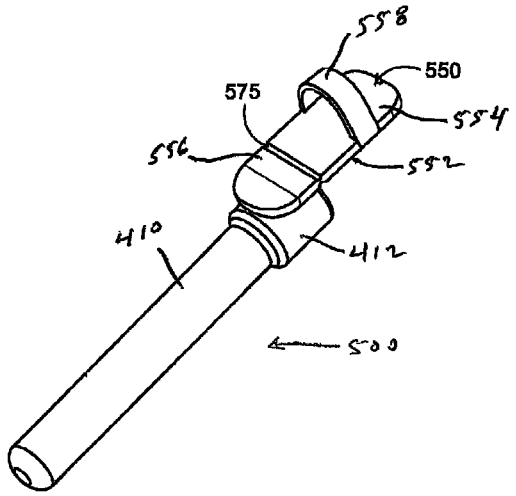
FIG. 14A is a perspective view of a fifth embodiment of a flashlight with an adjustable beam reflector.
Figure 14B:
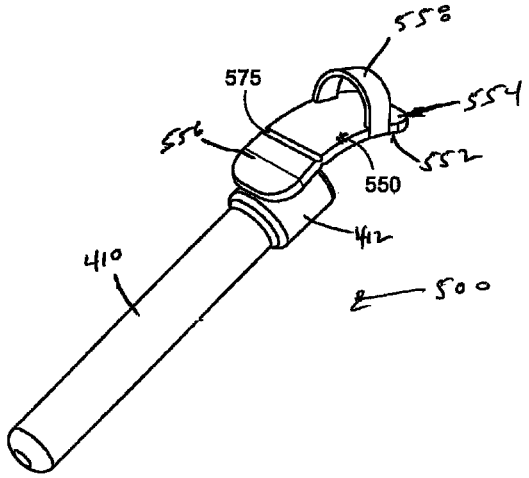
FIG. 14B is another perspective of the flashlight shown in FIG. 14A illustration the beam reflector in a light beam intercepting position.

Directing attention now to a fifth embodiment shown in FIG. 14A, a flashlight with an adjustable light beam reflector is generally identified by the reference numeral 500. As indicated by the use of common reference numerals, the flashlight 500 is similar to the flashlight 400 described above. The flashlight 500 may include a reflector 550 mounted on the head portion 412 of the flashlight body 410. The reflector 550 may, without limitation, be fabricated of flexible plastic or other suitably flexible material, and may include a reflective bottom surface 552. The reflector 550 may be fixedly secured to the head portion 412 of the flashlight body 410 in a conventional manner. A forward portion 554 of the reflector 550 may extend forward of the head portion 412 of the flashlight body 410 in a longitudinal direction. A living hinge 575 may connect the forward portion 554 to a rearward portion 556 of the reflector 550. The reflector 550 may include a finger loop 558 proximate its forward distal end for a user to insert a finger therethrough to manipulate the reflector 550. Living hinge 575 is of proper thickness as to allow both endurance and sufficient flexation such that deflection of available light rays to some lateral direction may be readily facilitated in an adjustable manner.

Figure 15:
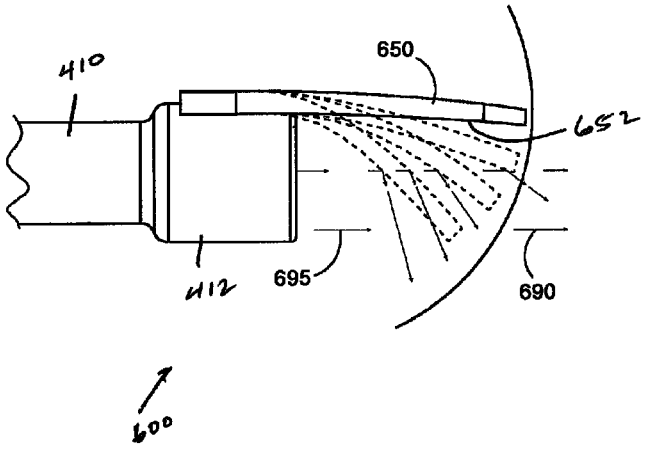
FIG. 15 is a side view of a sixth embodiment of a flashlight with an adjustable beam reflector.

Directing attention now to FIG. 15, a sixth embodiment of a flashlight with an adjustable light beam reflector is generally identified by the reference numeral 600. As indicated by the use of common reference numerals, the flashlight 600 is similar to the flashlight 400 described above. The flashlight 600 may include a reflector 650 mounted on the head portion 412 of the flashlight body 410. The reflector 650 may, without limitation, be fabricated of flexible plastic or other suitably flexible material, and may include a reflective bottom surface 652. The bottom surface 652 may be mirrored. The reflector 650 may be flexed along at least a portion of the reflective (mirrored) bottom surface 652, thus forming a variably curved reflector 650. The reflector 650 presents a complex reflective geometry such that extreme downward flexing of the reflector 650 focuses very concentrated light 695 to the foot path. In this manner, high degrees of flexation of the reflector 650 laterally introduces bright concentrated near field illumination of the foot trail or ground terrain, and low or nonexistant flexing of the reflector 650 allows most or all light rays 690 to continue toward a forward target.

Finally, the reader may note that in addition to smooth, faceted, and/or prismatic surfaces, the reflector 650 may exhibit some degree of translucence, for example but without limitation, the bottom surface 652 of the reflector 650 may be partially mirrored such that at least a portion of the light rays 690 is visible or transmitted through the reflector 650. Translucence of the reflector 650 may be desirable for permitting the light rays 690 to illuminate a forward target and simultaneously reflect laterally to illuminate the foot path, as well as increase a user's visibility to others and the like. Also, it should be noted that the reflector 650 may include a conventional lens mated to the reflective surface of the reflector 650 to further effect characteristics of the deflected light, or the reflector 650 may work in cooperation with a conventional lens including lens regions having plano, aspherical, or double convex characteristics, as well as a Fresnel type lens installed between the flashlight parabolic reflector and the reflector 650.

While a preferred embodiments of the invention has been shown and described, other and further embodiments of the invention may be devised without departing from the basic scope thereof, and the scope thereof is determined by the claims which follow.

The invention claimed is:

1. A flashlight comprising:

a) a flashlight body, said flashlight body including a head portion;

b) a fixed light beam source housed within said flashlight body;

c) a bracket mounted on said head portion of said flashlight body, said bracket including a pair of elongated ridge members in spaced relationship to one another, said ridges defining a channel therebetween extending generally parallel to a longitudinal axis of said flashlight body; and d) a light beam reflector movably supported between said ridge members constrained to move axially relative to said bracket to fully or partially deflect a light beam.

2. The flashlight of claim 1 wherein said reflector includes spaced apart arms extending from a distal end of said reflector, said arms slideably engaging said bracket.

3. The flashlight of claim 1 wherein said ridge members include an elongated curved slot generally defining a curved path extending from a forward portion to a rearward portion of said ridge members.

4. The flashlight of claim 3 wherein said arms of said light beam reflector include outwardly extending tabs sized for receipt in a respective said slot of said ridge members.

5. The flashlight of claim 4 including a forward stop and a rearward stop disposed in said slot of each said ridge members, wherein movement of said light beam reflector relative to said bracket is constrained between said forward stop and said rearward stop.

6. The flashlight of claim 1 wherein said light beam reflector includes a plurality of openings permitting portions of the light beam to pass through said openings.

7. The flashlight of claim 1 wherein said light beam reflector includes a bottom mirrored surface.

8. The flashlight of claim 7 wherein said light beam reflector includes a slight curvature along an axial length thereof, and said bottom mirrored surface defines a concave profile.

9. The flashlight of claim 7 wherein said light beam reflector includes a slight curvature along an axial length thereof, and said bottom mirrored surface defines a convex profile.

10. The flashlight of claim 1 including a spring disposed between said bracket and said light beam reflector providing a biasing force to maintain said light beam reflector in a first position.

11. The flashlight of claim 1 wherein said light beam reflector includes a translucent body transmitting a portion of a light beam through said translucent body and laterally reflecting a portion of the light beam.

12. The flashlight of claim 1 wherein said light beam reflector includes a partially mirrored bottom surface.

13. A flashlight comprising:

a) a flashlight body, said flashlight body including a head portion;

b) a fixed light beam source housed within said flashlight body; and c) said flashlight body movably supporting a light beam reflector, wherein said light beam reflector includes a translucent body simultaneously transmitting a portion of a light beam through said translucent body and laterally reflecting a portion of the light beam.

14. The flashlight of claim 13 wherein said light beam reflector includes a partially mirrored bottom surface.

* * * * *